US005896598A

United States Patent [19]

Jeans

[11] Patent Number: 5,896,598

[45] Date of Patent: Apr. 27, 1999

[54] INFLATABLE SEAT

[76] Inventor: Edward Lewis Jeans, Gwent, Wales, United Kingdom

[21] Appl. No.: 08/799,937

[22] Filed: Feb. 13, 1997

Related U.S. Application Data

[63] Continuation of application No. 08/374,644, Mar. 22, 1995, abandoned.

[30] Foreign Application Priority Data

May 27, 1992 [GB] United Kingdom ..... 9211250

[51] Int. Cl.[6] ..... A47K 3/02

[52] U.S. Cl. ..... 4/566.1

[58] Field of Search ..... 4/560.1, 564.1, 4/565.1, 566.1, 578.1

[56] References Cited

U.S. PATENT DOCUMENTS

| | | | |
|---|---|---|---|
| 3,346,885 | 10/1967 | Merriman . | |
| 4,495,666 | 1/1985 | Herman | 4/564.1 |
| 5,046,205 | 9/1991 | Garcia | 4/456 X |

FOREIGN PATENT DOCUMENTS

| | | |
|---|---|---|
| A 2537426 | 6/1984 | France . |
| A 2842214 | 4/1980 | Germany . |

*Primary Examiner*—Charles E. Phillips
*Attorney, Agent, or Firm*—Klauber & Jackson

[57] ABSTRACT

A seating device which comprises an inflatable seat (4) and an inflating means which provides for the controlled inflation and deflation of the seat. The seat (4) comprises a chamber defined by top, bottom and side walls (12, 13) which is connected to the inflation means. The inflation means comprises a motorised fan unit (20) and a control valve (6) connected by a supply pipe (10) to the seat (4). The device is inflatable from a deflated position on the base of a support surface such as a bath to an inflated position adjacent the rim of the bath such that a person sitting thereon can easily enter or exit the bath to bathe. The device is of particular use for handicapped or elderly persons and does not require mechanical actuation means and has sufficient inflatable characteristic to enable the seat to remain in a fixed position in relation to the bath.

9 Claims, 3 Drawing Sheets

10
34
6
32
30
31B
31A
31
22
35
37
43
39
24
8
36
47
45
49
40
41
38

INFLATABLE SEAT

This application is a continuation of application Ser. No. 08/374,644, filed Mar. 22, 1995, now abandoned.

This invention relates to a seating device, especially but not exclusively for use as a bathing aid. A particular embodiment of the invention is a bathing seat which fits inside a bath and which may be raised and lowered so as to enable an elderly or a handicapped person to enter the bath and be lowered to a position for bathing in the comfort of a conventional bath tub.

Many elderly and handicapped people experience difficulties in simple movements which able bodied people take for granted. For example climbing a flight of stairs is an easy task for some people but to some elderly and handicapped people the simple task becomes a hard one and to some it is completely beyond their strength. Similar problems exist when said elderly or handicapped people take a bath. To most people the action of lowering themselves into and raising themselves out of a bath is a very simple one but to others, especially the elderly and handicapped, this is a very difficult if not impossible task.

Many elderly and handicapped people who have such difficulties are tended by their family members. Bathing such persons can be difficult for untrained people in particular due to the requirement to lift the person in and out of the bath. In the worst cases the help of two people is required to lift or lower the said person into the bath however the most common cases involve the elderly or handicapped person requiring the aid of a helper to ensure that they do not fall or injure themselves. This has the added disadvantage of being potentially embarassing both to the helper and the elderly or handicapped person.

To overcome these problems a bathing chair of the type known can be used. One such known chair comprises a base unit which has suction pads so as to firmly secure the chair to the bottom of the bath, the base being connected to bellows which are connected to the underside of a conventional plastic seat. A power source is typically provided in the form of a rechargeable battery which is connected to drive a pump which in turn can pump water into the bellows so that the bellows are inflated and thereby the seat is raised from the bottom of the bath. An elderly or handicapped person can be positioned on the seat and the bellows exhausted to lower the seat and person thereon.

Other forms of mechanically actuated seating aids are also disclosed in German Patent application DE3825868 and European patent application 0131741. In the German patent application the seat comprises a series of four hingedly connected plates, each of which is acted upon by inflatable bags to raise and lower the said hinged plates. The movement created by this method is uneven and can be difficult to control due to the plurality of moving parts. The European application is again a mechanically arranged lifting means wherein a lifting frame is provided with an inflatable means but it is the frame and the sliding arrangement of the parts thereof which allows the person to be lifted and lowered. Again the device is complex and relatively difficult to use.

Bathing devices produced from inflatable panels are disclosed in patent applications DE3815392, SU 1581311 and DE3408234 but, in the case of the first two documents, the purpose is to raise the person from a lying position to an upright position in the bath by the provision of a movable back panel and not to aid a person in getting into and out of a bath.

DE3408234 provides a means for allowing a person into and out of the bath but relies on the seat being of a similar size to the bath such that the device, when inflated, will float on the surface of the water. This is an impractical method in that the device is not stable and can cause injury to the person when getting into or out of the bath.

None of the above devices therefore satisfactorily provide a non-mechanical seating device which is capable of being raised to the rim of the bath to allow a person to sit thereon and to be lowered such that the person can enter the water to bathe whilst maintaining the seating device in a fixed and stable position in relation to the bath.

A further problem which has been encountered is controlling the raising and lowering of the bathing seat so that the person can comfortably be positioned raised or lowered in or out of the bath. It has been found that many control systems currently used do not provide sufficient control means to allow the elderly or disabled person to be fully confident when using the apparatus.

The present invention seeks to overcome the problems so described above by providing a seating device which unobtrusively fits into the bath and which may be raised or lowered so as to enable an elderly or handicapped person to bathe. A further aim is to provide a seat which is shaped both to suit the person but also to have the capability of taking into account variation in the shape of the bath in which the device is to be used. The design of the device and the components associated therewith ensure that the device is relatively easy to use but also ensures that the device can be used with confidence in the safety of the device.

In accordance with the present invention there is provided a seating device for use in association with a support surface, said seating device comprising an inflating means for raising and lowering a wholly inflatable seat and wherein said person sits on the inflatable seat and is raised and lowered by said seat and the same is of a form to allow said seat, when inflated, to come into contact with the support surface to maintain the same in position.

Typically the seat will comprise an inflatable chamber defined by top, side and bottom walls. Preferably the top wall of the seat will be shaped such that the person, when sitting thereon, is held in a secure position.

The side walls will preferably be shaped such that when the same are inflated they assume substantially the form of the contours of the sides of the support surface such that they come into contact with the support surface to maintain the seat in position.

In one embodiment the external walls of the seat will be provided with suction means mounted thereon or formed integrally with the seat material. Typically said suction means will come into contact with the support surface and locate the seat firmly with the support surface. Preferably the suction means will be provided on the lower portion of each side wall of the seat and on the seat base such that they are in contact with the support surface both when the seat is inflated and, on deflation, the positioning of the suction means ensures that rolling down of the seat material will not disengage the suction means from the support walls.

In one embodiment the said seating device will comprise an inflatable seat, a control valve and a pressurised gas source. Typically the gas is blown by a fan unit to the seat to inflate same and is controlled by the user by a manual control valve.

The control valve will be adjustable to provide control of and interruption in the inflation and deflation of the seat. Preferably said control valve will operate in combination with a remote electrically controlled pressure switch which will serve to switch off the motorised fan unit when pressure in the gas supply tube to the seat reaches a predetermined upper level. This level will be such as to prevent the pressure of gas in the seat from becoming too great.

To interrupt the inflation of the inflatable seat the valve has defined therein an inner chamber which is linked to the pressure switch such that, during inflation of the seat the chamber can be sealed to cause a build up of pressure therein to activate the pressure switch and hence switch off the fan unit. Preferably the valve will be further adjusted thus causing the fan unit to be maintained in a switched off state.

In one embodiment said control valve will be provided with vents which will ensure that gas can escape during deflation from the seat through the vents. In one embodiment the vents will be closed by a one way valve comprising an external skirt which will be of a resilience such that when the gas pressure reaches a certain point within the valve the skirt will blow off the annular seat and hence allow gas to escape through the vents until the pressure returns to a lower level upon which the skirt will contract and again seal the vent.

In a preferred alternative embodiment the skirt is provided internally of the valve and is of a dimension to seal against an inner circumference of the valve. The skirt can be deflected from the inner circumference by the pressure of gas venting from the seat as the gas passes through the valve and deflection of the skirt allows the gas to continue to pass along the supply tube to exit through vents in the fan unit.

The advantage of this embodiment is that it provides for the venting of gas remote from the water and therefore ensures that no water can enter the system through the vents which, when provided at the control valve, may be possible should the valve be immersed in water during use.

Typically said control valve will have at least an inflate setting and a deflate setting but typically will have three settings as follows; a first setting to allow inflation of the seat, a second position to allow the seat, once inflated, to be maintained in that condition and a third position wherein the seat is allowed to deflate.

Preferably the vents provided will be of such a size as to ensure that the seat will deflate slowly thereby causing no discomfort to the user. Typically the control valve will comprise at least two components and the valve can be set to any of the three settings by relative movement of these components. The movement of the components will serve to open and close respective ports passing through the valve to allow the passage of gas in the required directions as appropriate. Typically the components will be in the form of casings and one casing will be guided in relation to another casing such that movement of one of the casings relative to the other will provide a known response in the valve and said casings will be sealed so as to prevent escape of gas and ingress of water therebetween.

Typically the support surface for the seat will be the interior walls of a bath and the seat will be capable of movement between an inflated position adjacent to the top rim of the bath and a deflated position wherein the seat is substantialy flat and unobtrusive to the person when bathing.

Typically the gas will be air and the fan unit will be in the form of an electrically operated air blower.

It will also be possible when required to attach various other bathing aids or supports to the inflatable seat by means of straps provided on the external surface of the seat.

Figure 1:
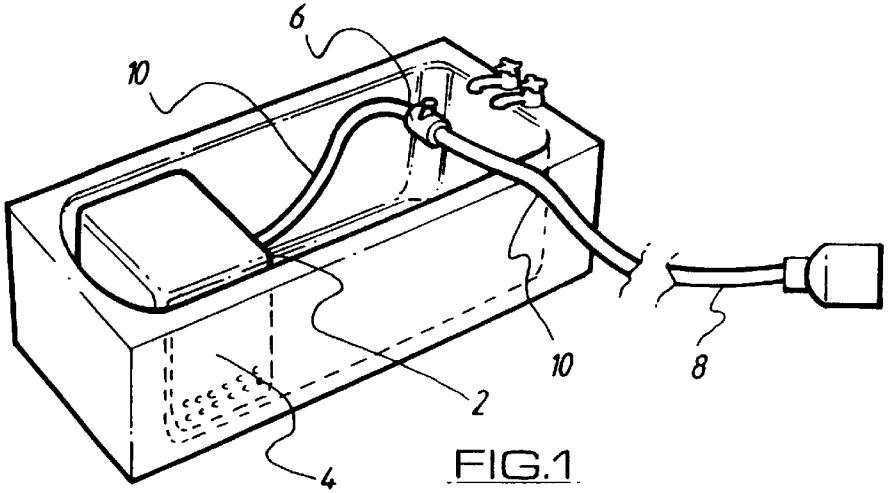
FIG. 1 shows a schematic diagram of the various elements of the seating device.

Referring firstly to FIG. 1 there is shown a seating device 2 of the invention. The said seating device is in this embodiment inflatable by air but the components can equally be used in conjunction with any gaseous medium. The apparatus comprises an inflatable seat 4, a control valve 6, a motorised fan unit which in this case is in the form of an air blower 8 and interconnecting pipes 10.

Figure 2:
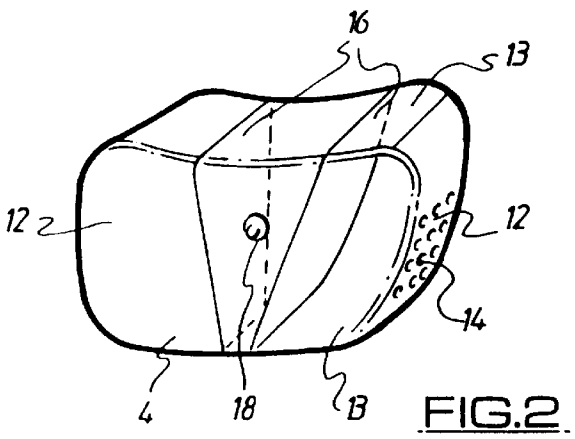
FIG. 2 illustrates a perspective of the seat of the invention.

FIG. 2 illustrates the seat 4 of the invention. The seat comprises a chamber which is defined by side walls 12 and top and bottom walls 13. The side walls 12 are typically shaped to mirror the shape of the walls of a bath such that, when inflated, the walls contact the bath walls to provide stability for the seat. To ensure a secure contact the side walls are provided with suction pads 14 said pads either integral with the seat or mechanically attached using straps on the inflatable seat, the said pads in either form designed to secure the side walls of the seat in suction with the bath walls. The top wall 13 of the seat is shaped to provide a comfortable and secure sitting area for a person, said shape typically concave. In order to maintain this shape and increase the rigidity of the seat there are provided inner tie means 16 which tie the top wall to the bottom wall and, when the seat is inflated, limit the upper inflation of the top wall and maintain the seating shape therein. The seat is provided with a port 18 into which the pipe 10 supplies air from the air blower 8.

Figure 3:
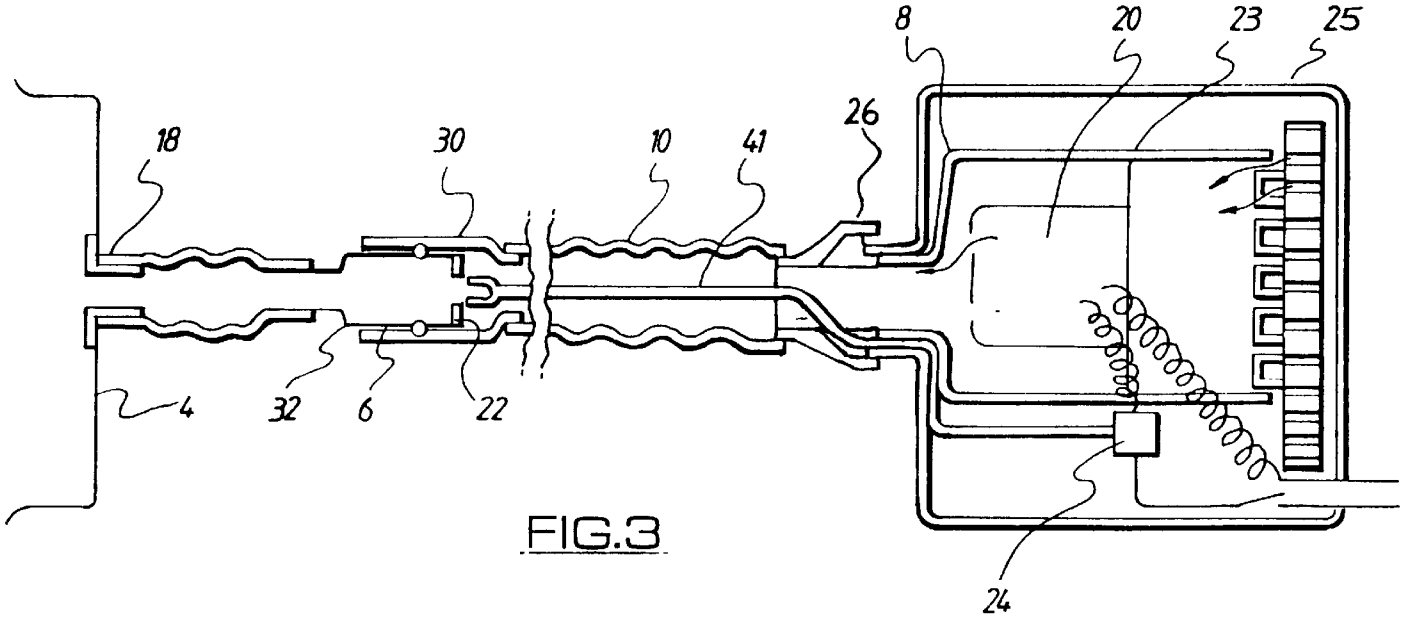
FIG. 3 shows in schematic form the components of the device as in use.

FIG. 3 shows the air blower 8 of the invention in greater detail. The air blower comprises a fan unit 20 which draws air into the blower and passes the same through a pipe 10 and check valve 22 which may be located as shown in control valve 6 or alternatively (not shown) in relief valve 26. This latter position necessitates external venting at the control valve past the skirt as described previously. Also provided in the air blower is a pressure switch 24 and the device is powered by a standard electricity supply remote from the bathing device. In addition there is provided a motor housing 25 and an outer housing 28 to isolate and contain respectively the pressure switch 24 and direct the air over the motor 20.

Figure 4:
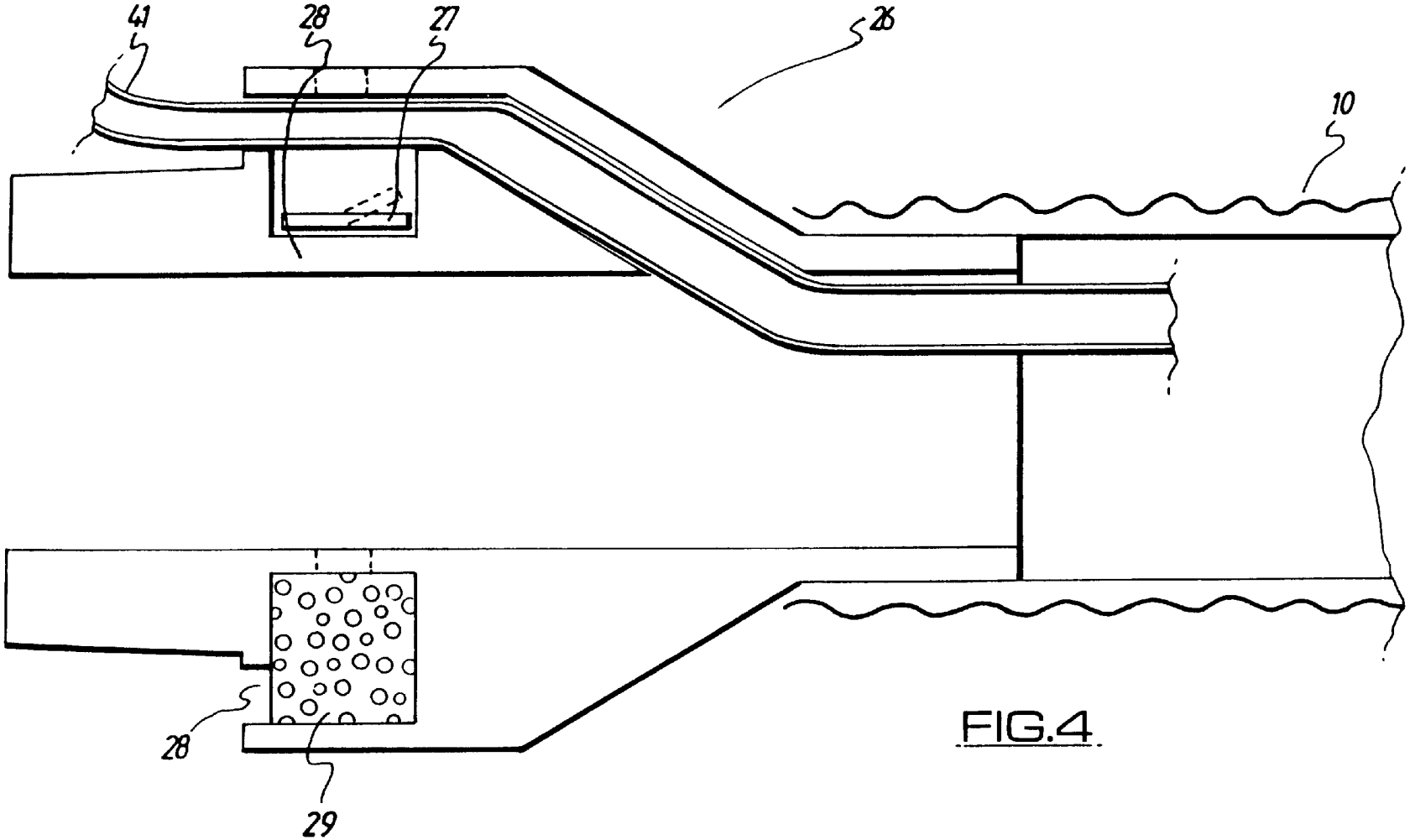
FIG. 4 shows in detail the relief valve element of the fan unit.

FIG. 4 illustrates the relief valve 26 of the air blower 8 in greater detail. It comprises a means to connect motor housing 25 to pipe 10 and to gauge air to and from the seat 4 via pipe 10 and control valve 6 and said relief valve has passing through it and diverted by it includes a pressure sensor tube 41 which exposes the pressure switch 24 to the pressure of the air in the chamber 49 of the valve 6. Should the pressure in the system rise to a preset level above that which can cause failure of part of the system, the valve 26 is provided with vents 28 which are normally closed by either skirts 27 or sponge diffusers 29. Said skirts are sufficiently resilient such that the vents are closed until a set pressure is reached, say for example 3 psi, wherein the skirts will expand and allow air to be vented from the vents 28, or alternatively the sponge diffusers allow only sufficient air to pass so as to maintain an internal pressure which is adequate to inflate the seat under load. In addition the relief feature allows air to pass through the motor housing when the same is running even when no air is passing through the control valve thereby keeping the motor cool. Should the temperature rise to a critical level a thermally sensitive cut off switch is provided.

Figures 5, 6, 7:
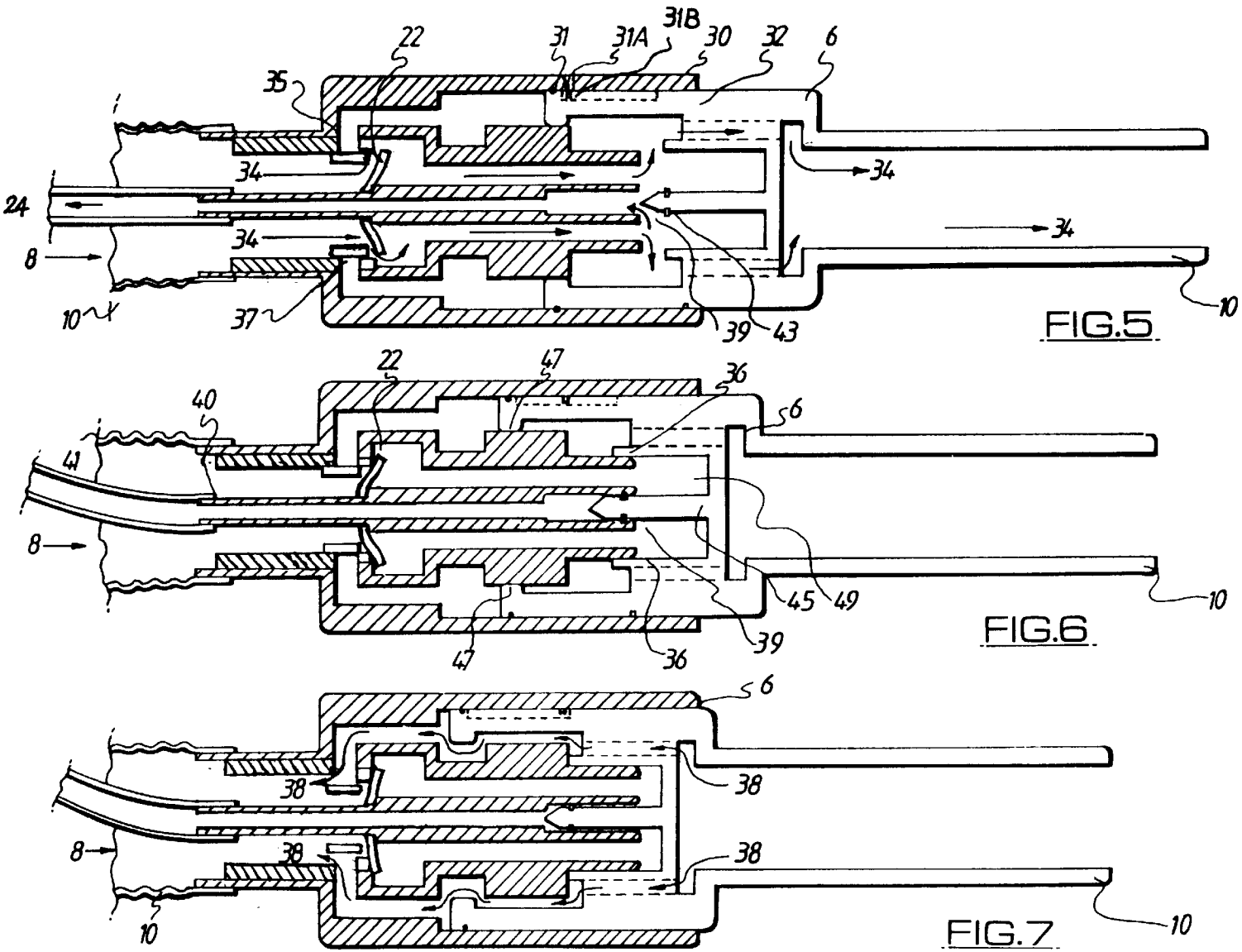
FIGS. 5, 6 and 7 illustrate detailed sectional views of the control valve of the invention in the three setting positions.

Referring now to FIG. 5,6 and 7 there is shown a control valve 6 of the invention in cross section wherein in each of the Figures air is supplied from the air blower 8 to the valve 6 and is then connected to the inflatable seat 4 by a continuation of pipe 10. The valve consists of an outer casing 30 which is disposed to move relative to an inner casing 32. Each of the outer casing and inner casing is provided with a series of ports and vents, said ports and vents being closable and openable by this movement of the outer casing 30 relative to the inner casing 32. Typically both the outer casing 30 and inner casing 32 are provided with annular recesses, the walls of which selectively engage with each other during operation of the valve. The casing 30 is also provided with inner protrusions 31 which pass along guide paths 31a provided on the outside of the inner casing 32 such that the rotation of the outer casing 30 is, in effect, a spiral movement and also ensures that the correct ports and vents are connected to provide the correct operation of the valve 6 when required.

Referring now to FIG. 5 the valve 6 is shown in a position wherein the seat can be inflated i.e. the valve allows the passage of air from the blower 8 to the seat 4 via pipe 10. In this embodiment the air passes as shown by arrows 34 through the valve from the blower to the seat and also to the pressure switch 24 through port 39 and sensor tube 41. Air is prevented from escaping through vents 37 by contact between the faces 47.

FIG. 6 illustrates the position of the valve when the seat is sufficiently inflated and should be held in that position. The air is therefore trapped in the seat and also no further air can enter. This is caused by the contact of the faces 36 and 47 backed up by check valve 22 which prevent air entry or exit through the valve, and at the same time the pressure switch is isolated by the seal provided by the O-ring 43 on probe 45 sealingly engaging port 39.

FIG. 7 illustrates the embodiment of the valve when the seat is required to be deflated to allow the person to be lowered into the bath to bathe. The outer casing 30 is again moved from the position of FIG. 6 such that air, represented by arrows 38 is allowed to pass through the valve to vents. The vents are normally closed by skirts 35 formed of rubber which operate as a one-way valve closing the vents 37 while the blower is on but when the faces 47 are disengaged as in FIG. 7 they allow the controlled escape of air back through the tube 10 and fan unit housings 25 and 28 to atmosphere hence the seat deflates in a controlled manner.

The valve is further designed such that deflation and inflation of the seat can be interrupted at will. When the seat is deflated the motor will have been switched off automatically and hence control or interruption of the deflation is obtained by selectively obstructing the vent passage by returning valve 6 to the position as shown in FIG. 6, to bring faces 47 back into contact. However to interrupt inflation it is preferable not only to prevent air entering the seat by obstructing the flow at the faces 36 but also to cause the air blower or any other fan unit to switch off. This latter action is effected by ensuring that the valve is constructed such that the contact of the faces 36 occurs before the pressure switch is isolated by the insertion of the O-ring 43 on the probe 45 into the port 39. In these circumstances a chamber 49 is defined by the check valve 22 and the contact of faces 36. The chamber is quickly pressurised by the blower via tube 10 and the pressure switch actuated thus preventing any further inflation of the seat 4. The blower can then be maintained in a switched off state by movement of the valve components to assume the position of FIG. 6.

To operate the device the user is first required to inflate the seat. To do so the device is connected as shown in FIG. 1 and the air blower 8 switched on. To ensure that the air is supplied to the seat the outer casing 30 of the control valve 6 should be turned to the position as shown in FIG. 5 thus allowing air to pass through the valve and via pipe 10 to inflate the seat. During this process the pressure switch 24 monitors the pressure in the air pipe to ensure that the seat does not become overinflated. Once the air pressure in the pipe and hence the seat reaches a preset level the pressure switch will disengage the air blower motor 20 and check valve 22 prevents the escape of air back through the supply pipe 10 as does contact of the faces 47. To maintain the seat in the desired inflated state the person will then turn the outer casing 30 of control valve 6 to the position as shown in FIG. 6. This serves to "lock" the air in the inflated seat and prevent any leakage. Furthermore it prevents the pressure switch from switching the air blower back on and causing "hunting" to occur wherein the air blower is switched on and off intermittently as the air pressure fluctuates, as a result of any minor leaks in the system.

Once the person is on the inflated seat 4 the seat is then deflated to allow bathing by moving the control valve to the position of FIG. 7 such that the air is allowed to vent from the seat and through the vents provided either back through the supply hose as shown in the embodiment or via an external resilient skirt closing a port in the control valve but not shown. In any case this allows the seat to deflate the person to bathe as normal. To leave the bath the person rotates the outer casing 30 of the valve 6 to the position of FIG. 5 and hence the pressure switch will be exposed to low pressures and air blower will switch on and the seat will be reinflated to the rim of the bath.

As can be seen therefore the seating device of the invention is clearly a simple and beneficial device to allow an elderly or handicapped person to bathe. Importantly a person can use the device independently thereby increasing privacy.

The invention provides a means for allowing a person to enter a bath whereby the person can, by sitting on the seat be lowered from a height equal to the height of the bath rim into the bath water to bathe. The invention does not require any mechanical actuation or supporting frame and therefore is much simpler than any of the conventional devices and is therfore much more attractive for use and cheaper to manufacture. The invention, importantly, also provides a secure lifting seat on which a person can be confidently and comfortably raised and lowered.

The invention can be used with any gaseous medium and the air blower substituted by any appropriate powered fan unit.

I claim:

1. A seating apparatus for a person for use in association with a support surface, said apparatus comprising an inflating means for raising and lowering a wholly inflatable seat and said person sits on the inflatable seat and is raised and lowered by said seat and the seat is of a form to allow same, when inflated, to come into contact with the support surface and to maintain said seat in position, wherein said inflating means includes a pressurized gas source, a fan unit, and a control valve with a pressure sensing means, for control of the pressurized gas source, wherein the control valve can be altered to provide control of and interruption in the inflation and deflation of the seat, wherein the pressure sensing means is a switch capable of switching the pressurized gas source on or off dependent on the gas pressure, wherein the control valve of the inflating means is linked with a pressure switch, said switch connected to the fan unit wherein said pressure switch is capable of switching the fan unit on or off dependent on the gas pressure, and wherein the control valve has defined therein a chamber linked to interrupt inflation such that, during inflation of the seat, the chamber can be sealed to cause a build up of pressure to activate the pressure switch and hence switch off the fan unit.

2. The seating apparatus according to claim 1 wherein further adjustment of the control valve causes the fan unit to be maintained in that position.

3. A seating apparatus for a person for use in association with a water bath, said apparatus comprising:

an inflating means for raising and lowering a wholly inflatable seat, wherein the person sits on said inflatable seat and is raised and lowered by said seat, and wherein said seat is adapted to contact the water bath when said seat is inflated, thereby maintaining said seat in position within the water bath;

wherein said inflating means includes a pressurized gas source, a control valve and a pressure sensing means, for controlling said pressurized gas source;

wherein said control valve is actuated by the person to provide control of the inflation and deflation of said seat;

wherein said pressure sensing means is capable of controlling the gas pressure in said apparatus; and wherein said control valve is linked with said pressure sensing means and said pressurized gas source, said control valve being capable of modifying the gas pressure in said apparatus; and wherein said control valve includes a chamber defined therein, wherein; during inflation of said seat, said chamber is capable of being sealed to cause a buildup of pressure therein, thereby activating said pressure sensing means and isolating said pressurized gas source, whereby inflation is interrupted.

4. The seating apparatus according to claim 3 wherein said pressure sensing means comprises a pressure switch linked to said pressurized gas source, and wherein said switch is capable of activating or deactivating said pressurized gas source in response to the gas pressure.

5. The seating apparatus according to claim 3 wherein said control valve is capable of being adjusted to cause said pressurized gas source to remain isolated.

6. The seating apparatus according to claim 3 wherein said control valve further comprises at least one vent which is capable of allowing the gas from said inflatable seat to escape therethrough when said control valve is in a deflating position.

7. The seating apparatus according to claim 6 wherein said vent is further adapted to control the rate of deflation of said inflatable seat.

8. The seating apparatus according to claim 3 wherein said pressurized gas source is an electrically powered air fan unit.

9. The seating apparatus according to claim 3 wherein said inflatable seat further comprises top, side and bottom walls, and wherein at least the lower part of the side walls and/or bottom wall of said inflatable seat are provided with suction means for maintaining fixed contact between said seat and the support surface.

* * * * *